United States Patent [19]

Hintsch et al.

[11] Patent Number: 4,518,019

[45] Date of Patent: May 21, 1985

[54] LUBRICATOR FOR A WEFT PICKING ELEMENT IN A WEAVING MACHINE

[75] Inventors: Otto Hintsch, Wallisellen; Gerd Schmitz, Sulz-Attikon, both of Switzerland

[73] Assignee: Sulzer Brothers Limited, Winterthur, Switzerland

[21] Appl. No.: 523,418

[22] Filed: Aug. 16, 1983

[30] Foreign Application Priority Data

Aug. 26, 1982 [EP] European Pat. Off. ..... 82810354.9

[51] Int. Cl.[3] ..... D03J 1/00

[52] U.S. Cl. ..... 139/1 R; 139/45; 139/438

[58] Field of Search ..... 139/1 R, 45, 437, 438; 184/6.26, 7, 12, 6

[56] References Cited

U.S. PATENT DOCUMENTS

| | | | |
|---|---|---|---|
| 4,003,409 | 1/1977 | Steffens | 139/45 |
| 4,117,869 | 10/1978 | Rushman | 139/438 |
| 4,155,378 | 5/1979 | Senn | 139/45 |
| 4,205,708 | 6/1980 | Burgbacher | 139/45 |

*Primary Examiner*—Henry S. Jaudon

*Attorney, Agent, or Firm*—Kenyon & Kenyon

[57] ABSTRACT

The lubricator is disposed at the picking end of the picking element return device and has a guide duct for receiving a picking element prior to the next pick. The lubricator has oil mist nozzles which face only those surfaces of the picking element which will rub on the guide teeth in the next pick.

Very low-quantity lubrication or lean lubrication is feasiable and soiling of the fabric by lubricant is obviated. The lubrication effect is sufficient to obviate metal abrasion between the picking element and the guide teeth so that soiling of the fabric by abraded metal can be avoided.

17 Claims, 5 Drawing Figures

LUBRICATOR FOR A WEFT PICKING ELEMENT IN A WEAVING MACHINE

This invention relates to a lubricator for a weft picking element in a weaving machine.

Heretofore, various weaving machines have been known to employ picking elements for picking a weft yarn into a shed of warp yarns. In many instances, the weft picking element has been guided through the shed by way of a series of guide elements. Generally, the picking element has been picked from a picker or picking station on one side of the weaving machine to a catcher or catching station on the opposite side of the machine and, thereafter, returned from the catching station to the picking station, for example by a conveying mechanism.

In some cases, for example as described in German Pat. No. 2,246,921, the picking element has been guided into a matching octahedral or octagonal guide duct at the picker upon completion of the return movement and provided with lubricant. To this end, the duct has been bounded at the top by an oil-impregnated braking felt which provides contact lubrication of oil on three adjacent rubbing or sliding surfaces of the picking element.

In the past, since the oil has a tendency to creep off the lubricated surfaces unto the unlubricated surfaces of the picking element, a relatively large quantity of lubricating oil has been delivered to the picking element to insure that sufficient oil attains to the rubbing surfaces which are not in contact with the felt. Generally, the creeping off of the oil passes off relatively slowly. Accordingly, because of the high speed of the operating cycle, the rubbing surfaces not in contact with the felt are sufficiently wetted but, after a number of picks. However, such a copious lubrication of a picking element may lead to soiling of the fabric being woven with oil during picking.

Accordingly, it is an object of the invention to reduce the amount of lubricant required for a weft picking element.

It is another object of the invention to provide a relatively simple means of lubricating a weft picking element for a weaving machine.

It is another object of the invention to reduce the risk of soiling of a fabric being woven on a weaving machine.

Briefly, the invention provides a lubricator for a weaving machine which is comprised of a means which defines a guide passage having a plurality of guide surfaces for receiving a weft picking element with a plurality of complementary surfaces and a plurality of lubricant supply nozzles which communicate with selected ones of the guide surfaces for delivering lubricant thereto in order to lubricate complementary surfaces on a received picking element. That is, the lubricant supply nozzles communicate only with the guide surfaces of the passage which face those surfaces of the picking element which will slide on guide surfaces of a series of guide elements for guiding the picking element through a shed of warp yarns in the weaving machine.

The lubricator permits only those rubbing surfaces of a picking element which will actually contact the guide elements during picking to be lubricated shortly before picking. Lubrication can, therefore, be reduced considerably. This, in turn, minimizes the risk of the fabric being woven on the weaving machine from being soiled due to excessive lubrication of the picking element.

As a result of lubricating only the rubbing surfaces of the picking element, these surfaces are protected from abrasion on the guide elements during picking through the shed. Thus, soiling of the fabric by abraded metal from the guide elements and picking elements is obviated.

The lubricant may be supplied through the supply nozzles in the form of a lubricant mist. In this case, recesses may be provided in the guide surfaces facing the picking element so as to permit dissipation of the air from the lubricant mist.

In another embodiment, absorbant resilient members may be disposed in the respective guide surfaces which are to receive lubricant. In this case, a means may also be provided for biasing each resilient member in a direction into the guide passage in which the picking element is to be received.

These and other objects and advantages of the invention will become more apparent from the following detailed description taken in conjunction with the accompanying drawings wherein.

Figure 1:
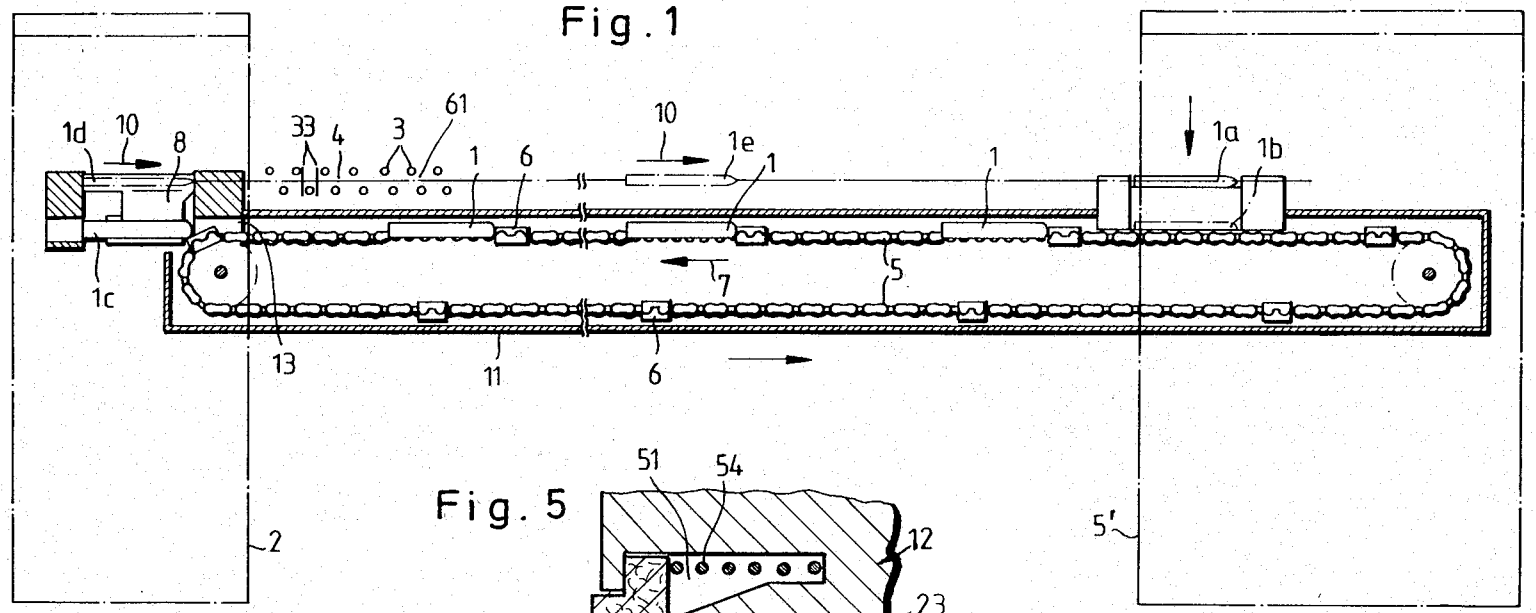
FIG. 1 illustrates a diagrammatic view of a weaving machine employing a lubricator in accordance with the invention.

Reffering to FIG. 1, the weaving machine is constructed such that a series of weft picking elements 1, for example in the form of gripper projectiles, can be picked during weaving by a picking mechanism or picker 2 from a picking station on one side of the machine in the direction indicated by the arrow 10 through a shed 4 formed by warp yarns 3 to a catcher 5' at a catching station on the opposite side of the machine. During picking through the shed 4, the picking elements 1 slide in a series of guide elements, for example in the form of guide teeth 33. Upon reaching the catcher 5', the picking elements 1 come to a standstill.

The weaving machine also employs a suitable guide (not shown) whereby the picked picking elements may pass from the position 1*a* illustrated in FIG. 1 to a return device (position 1*b*). This return device includes an endless chain 5 or conveyor to which entraining elements 6 are secured. The chain and entraining elements 6 serve to return the picking elements to the picker 2 (position 1*c*) in the direction indicated by the arrow 7. From the position 1*c*, the picking elements 1 are raised by a lift 8 to an initial position 1*d* in which the elements are ready for a further pick.

Figure 2:
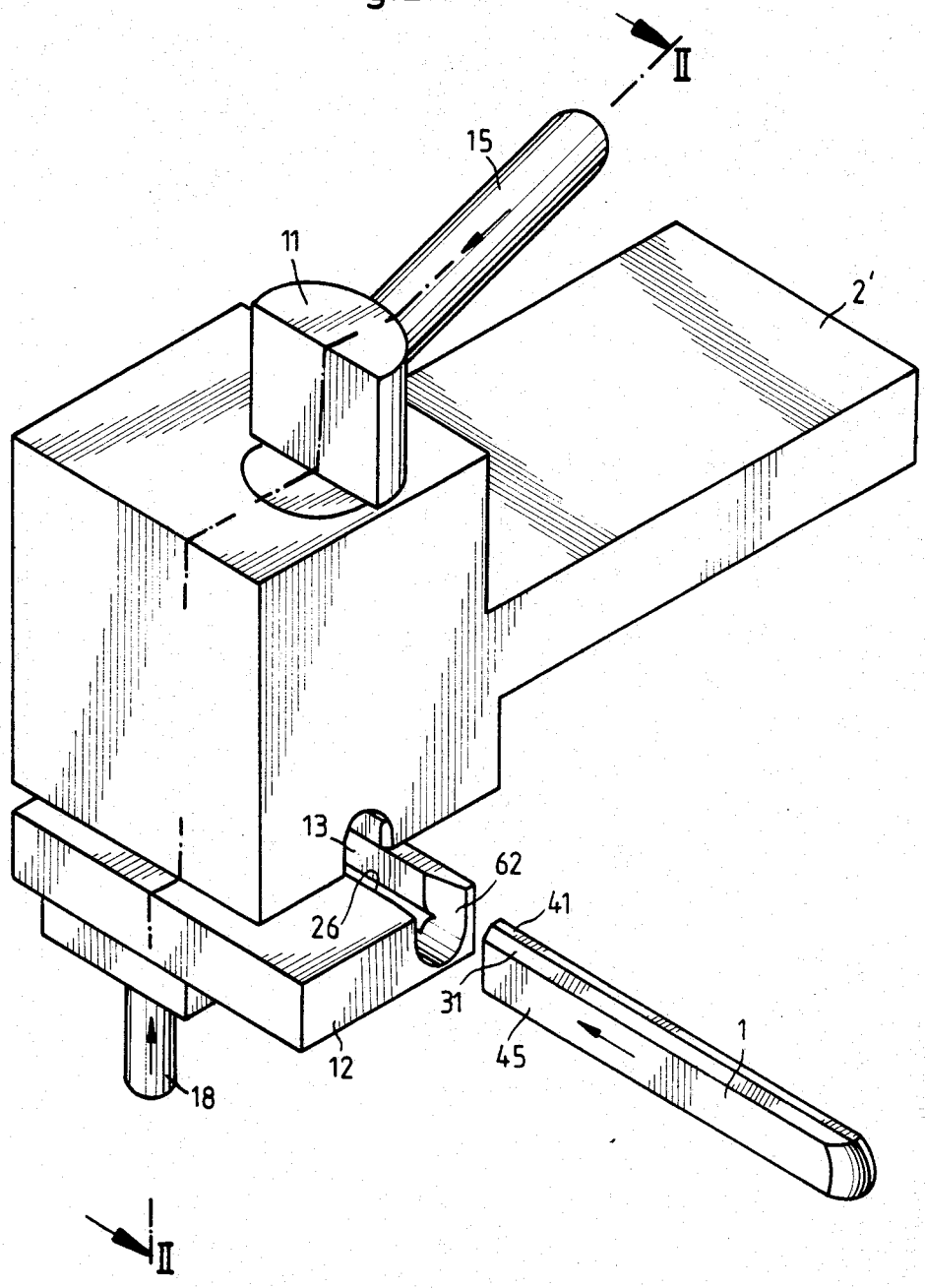
FIG. 2 illustrates a perspective view of a lubricator according to the invention.
Figures 3, 4:
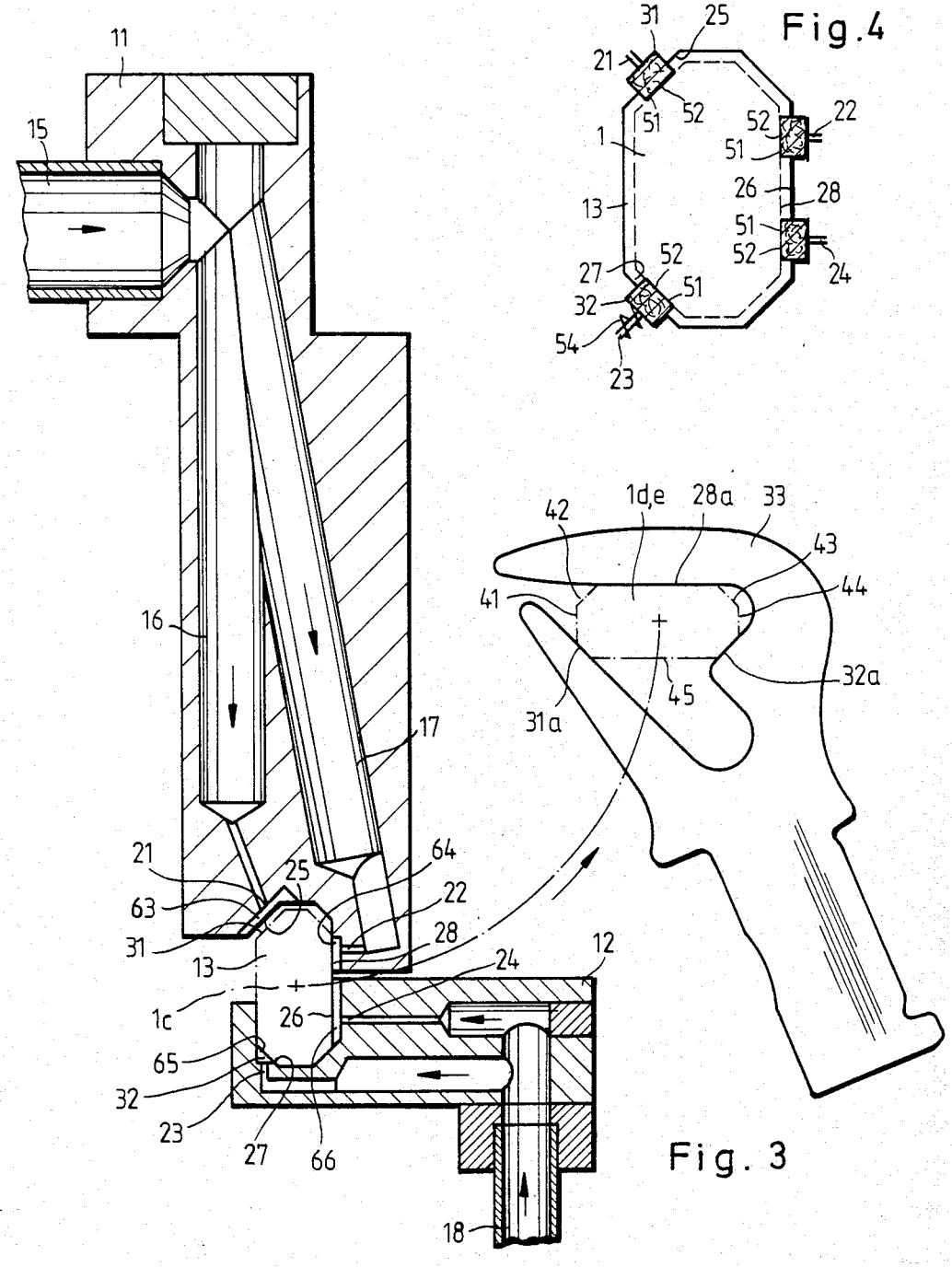
FIG. 3 illustrates a view taken on line II—II of FIG. 2.
FIG. 4 illustrates a part cross-sectional view of lubricator having absorbant resilient members for applying lubricant to the surfaces of a picking element.

Referring to FIG. 2, a part 2' of the picker 2 is provided with a lubricator for lubricating each picking element 1. In this regard, the lubricator includes two lubricating nozzle inserts 11, 12 which cooperate to bound a guide passage 13 having a conical entry 62 for a picking element 1. As indicated in FIG. 3, one nozzle insert 11 is formed with a pair of lubricant passageways 16, 17 which communicate with a lubricant supply duct 15 in order to receive lubricant therefrom. In like manner, the other nozzle insert 12 has a pair of lubricant passageways which communicate with a supply duct 18 to receive lubricant. In addition, the passageway 16 merges into a lubricant supply nozzle 21 formed with a recess 64, passageway 17 merges into a nozzle 22 formed with a recess 64 and the passageways extending from the supply duct 18 merge into nozzles 23, 24 each formed with a recesses 65, 66. As indicated, the nozzle 21 communicates with as inclined guide surface 25 of the passage 13, nozzle 22 communicates with a straight guide surface 26, nozzle 24 communicates with an extension of the straight surface 26 and nozzle 23 communicates with an inclined surface 27. Where an oil mist is supplied via the nozzles 21–24, the recesses 63, 66 permit the air present in the oil mist to be discharged as a picking element 1 passes by.

As shown in FIG. 2, each picking element 1 and guide passage 13 have a polygonal cross-section, for example being octahedral or octagonal. Further, the nozzles 21, 23 provide oil mist lubrication of inclined rubbing surfaces 31, 32 of the picking element 1. These rubbing surfaces 31, 32 face the inclined surfaces 25, 27 of the guide passage 13. The nozzles 22, 24 provide oil mist lubrication of a straight rubbing surface 28 on the picking element 1 which faces the surface 2 of the passage 13.

Of note, a picking element 1 enters the guide passage 13 in a vertical position 1*c* as indicated in FIG. 3. The lift 8 turns the picking element 1 into a horizontal position 1*d* for picking. The lubricating position 1*c* and the picking position 1*d* are illustrated in chain-dotted lines. The picking position 1*d* corresponds to the picking element position 1*e* during picking when the element moves inside the guide teeth 33 (only a few of which are shown in FIGS. 1 and 3). As can be gathered from positions 1*d*, 1*e*, during picking, the picking element 1 is guided in the teeth 33 via the inclined rubbing surfaces 31, 32 and straight rubbing surface 28 which are now in the positions 31*a*, 32*a*, 28*a* (see FIG. 3) for picking. The other element surfaces 41–45 do not act as rubbing surfaces during a picking operation, i.e. they do not contact the teeth 33. Consequently, the nozzles 21–24 do not lubricate the non-contact surfaces 41–45 when the picking element is in the lubricating position 1*c*. Thus, only those rubbing surfaces of the picking element 1 which will contact the teeth 33 in the immediately subsequent pick are lubricated.

The arrangement of the lubricator is such that the picking element 1 is rotated through 180° at its next entry into the passage 13. The nozzles 21, 23 then apply an oil mist to the inclined surfaces 31, 32 while the nozzles 22, 24 apply an oil mist to the straight surface 28 as these surfaces will be contacting the guide teeth 33 on the next pick. The picking element 1 is then turned into the position illustrated in FIG. 3 with these surfaces 28, 31, 32 lubricated.

Since only those picking element surfaces which will contact the guide teeth 33 during the next pick are lubricated before picking, a very reduced amount of oil is needed to lubricate these surfaces. For instance, no precautions are needed to insure that lubrication of the non-contacting surfaces 41, 42 leads to lubrication of the surfaces 31, 28 as a result of oil creep which would result only from relatively intense lubrication of these surfaces 41, 42 with the concomitant increased risk of soiling of the fabric.

As a variant, a picking element of other cross-section, for instance, a hexagonal cross-section can be used. In this case, the guide duct 13 is adapted in a corresponding manner and is, for instance, hexagonal. In addition, the guide teeth are also adapted in an appropriate manner. Further, the picking element may be of other shapes such that the portions near the surfaces, 31, 41, 42 and 44, 43 are spherical or rounded.

The picking elements may also be made, for example as gripper rods instead of gripper projectiles. Again, where gripper rods are used, the rods are lubricated only on those rubbing surfaces which are to contact the guide elements in the shed.

The number of rubbing surfaces of the picking element which contact the guide elements may vary according to the construction of the guide elements. Hence, the number of surfaces lubricated in the passage 13 may vary.

Figure 5:
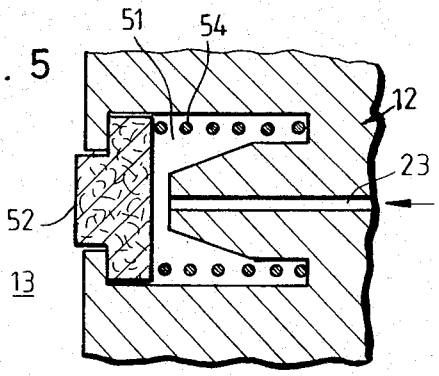
FIG. 5 illustrates an enlarged view of a biased absorbant resilient member for applying lubricant to a picking element surface in accordance with the invention.

Referring to FIG. 4, the lubricator may be provided with lubricant supply nozzles 21–24 which terminate at the ends near the passage 13 in a chamber 51 in which an absorbant resilient member such as a lubricant-impregnated felt 52 is disposed. In this case, the felt 52 extends into the passage 13 to provide contact lubrication only of the appropriate rubbing surfaces 28, 31, 32 of the picking element 1; the other surfaces not being lubricated by the felt 52. As indicated in FIG. 5, a means may also be provided for biasing each felt 52 in a direction into the guide passage 13. In this case, the means is in the form of a spring 54 which is contained within the chamber 51.

Since the felts 52 are supplied preferably with oil mist, a lubrication which is uniform in time and very reduced (lean lubrication) can be provided for the rubbing surfaces of the picking element.

Of note, the lubricant supply to the nozzles 21, 24 of the lubricator can be in the form of a mist or a liquid. Further, the lubricant supply may be continuous or intermittant and may possibly proceed in accordance with a lubricating program at the cadence of the working cycle of the weaving machine.

The invention thus provides a lubricator of relatively simple construction for supplying lubricant only to those surfaces of a picking element which are to subsequently slide on a guide surface when passing through a shed of warp yarns. Thus, there is a reduced risk of lubricant soiling the fabric which is being woven. Also, there is a reduced need for lubricant since only those surfaces which require lubrication are actually provided with lubricant.

What is claimed is:

1. A lubricator for a weaving machine comprising means defining a guide passage outside a shed of warp yarns having a plurality of guide surfaces for receiving a weft picking element with a plurality of complementary surfaces thereon;

a plurality of lubricant supply nozzles communicating with selected ones of said guide surfaces for delivering lubricant thereto to lubricate complementary surfaces on a received picking element to be guided in said shed; and at least one lubricant supply duct for supplying a lubricant oil mist to said nozzles.

2. A lubricator as set forth in claim 1 which further comprises a plurality of recesses in said means, each said recess being disposed in a respective selected one of said guide surfaces and communicating with a respective lubricant supply nozzle to permit dissipation of air from a lubricant mist supplied through said supply nozzle.

3. A lubricator as set forth in claim 1 wherein said guide passage is of polygonal cross-section and said selected ones of said guides surfaces consist of two inclined surfaces on one side of said guide passage and a flat surface on an opposite side of said guide passage.

4. A lubricator as set forth in claim 1 which further comprises a plurality of absorbent resilient members in said means, each member being disposed in a respective selected one of said guide surfaces and communicating with a respective lubricant supply nozzle to receive a supply of lubricant for transfer to a picking element in said guide passage.

5. A lubricator as set forth in claim 4 which further comprises means for biasing each resilient member in a direction into said guide passage.

6. In combination with a weaving machine having a plurality of guide elements for guiding a weft picking element through a shed of warp yarns, each said guide element having a plurality of guide surfaces for slidingly contacting corresponding surfaces of the picking element, a lubricator comprising means defining a guide passage outside said shed having a plurality of guide surfaces for receiving a picking element, said guide surfaces of said passage being complementary to the surfaces of the picking element; and a plurality of lubricant supply nozzles communicating with selected ones of said guide surfaces of said passage corresponding to said guide surfaces of said guide elements for delivering lubricant thereto to lubricate complementary surfaces of the received picking element whereby only those picking element surfaces which will contact said guide element guide surfaces during a subsequent pick are lubricated before picking.

7. The combination as set forth in claim 6 wherein said lubricator further comprises a plurality of recesses in said means, each said recess being disposed in a respective selected one of said guide surfaces and communicating with a respective lubricant supply nozzle to permit dissipation of air from a lubricant mist supplied through said supply nozzle.

8. The combination as set forth in claim 6 wherein said guide passage is of polygonal cross-section and said selected ones of said guide surfaces consist of two inclined surfaces on one side of said guide passage and a flat surface on an opposite side of said guide passage.

9. The combination as set forth in claim 6 wherein said lubricator further comprises a plurality of absorbent resilient members in said means, each member being disposed in a respective selected one of said guide surfaces and communicating with a respective lubricant supply nozzle to receive a supply of lubricant for transfer to a picking element in said guide passage.

10. A method of lubricating a weft picking element having guide surfaces which slidingly contact corresponding surfaces of guide elements in a shed of a weaving machine, said method comprising the steps of receiving the picking element in a guide passage having a plurality of guide surfaces complementary to the surfaces of the picking element, and delivering lubricant only to selected ones of said guide surfaces of said guide passage corresponding to the guide surfaces of the picking element for delivery of the lubricant to said guide surfaces of the picking element.

11. A method as set forth in claim 10 wherein lubricant is delivered in lubricating mist pulses.

12. A method as set forth in claim 11 wherein air pulses are delivered intermittently with the lubricating mist pulses.

13. A method as set forth in claim 11 wherein said pulses are delivered as a picking element passes through the guide passage.

14. A lubricator for a weaving machine comprising means defining a guide passage having a plurality of guide surfaces for receiving a weft picking element with a plurality of complementary surfaces thereon;

a plurality of lubricant supply nozzles communicating with selected ones of said guide surfaces for delivering lubricant thereto to lubricate complementary surfaces on a received picking element; and a plurality of recesses in said means, each said recess being disposed in a respective selected one of said guide surfaces and communicating with a respective lubricant supply nozzle to permit dissipation of air from a lubricant mist supplied through said supply nozzle.

15. A lubricator for a weaving machine comprising means defining a guide passage of polygonal cross-section having a plurality of guide surfaces for receiving a weft picking element with a plurality of complementary surfaces thereon; and a plurality of lubricant supply nozzles communicating with selected ones of said guide surfaces for delivering lubricant thereto to lubricate complementary surfaces on a received picking element, said selected ones of said guide surfaces consisting of two inclined surfaces on one side of said guide passage and a flat surface on an opposite side of said guide passage.

16. In combination with a weaving machine having a plurality of guide elements for guiding a weft picking element through a shed of warp yarns, each said guide element having a plurality of guide surfaces for slidingly contacting corresponding surfaces of the picking element, a lubricator comprising means defining a guide passage having a plurality of guide surfaces for receiving a picking element, said guide surfaces of said passage being complementary to the surfaces of the picking element;

a plurality of lubricant supply nozzles communicating with selected ones of said guide surfaces of said passage corresponding to said guide surfaces of said guide elements for delivering lubricant thereto to lubricate complementary surfaces of the received picking element; and a plurality of recesses in said means, each said recess being disposed in a respective selected one of said guide surfaces and communicating with a respective lubricant supply nozzle to permit dissipation of air from a lubricant mist supplied through said supply nozzle.

17. In combination with a weaving machine having a plurality of guide elements for guiding a weft picking element through a shed or warp yarns, each said guide element having a plurality of guide surfaces for slidingly contacting corresponding surfaces of the picking element, a lubricator comprising means defining a guide passage of polygonal cross-section having a plurality of guide surfaces for receiving a picking element, said guide surfaces of said passage being complementary to the surfaces of the picking element; and a plurality of lubricant supply nozzles communicating with selected ones of said guide surfaces of said passage corresponding to said guide surfaces of said guide elements for delivering lubricant thereto to lubricate complementary surfaces of the received picking element, said selected ones of said guide surfaces consisting of two inclined surfaces on one side of said guide passage and a flat surface on an opposite side of said guide passage.

* * * * *

UNITED STATES PATENT AND TRADEMARK OFFICE

CERTIFICATE OF CORRECTION

PATENT NO. : 4,518,019

DATED : May 21, 1985

INVENTOR(S) : Otto Hintsch & Gerd Schmitz

It is certified that error appears in the above-identified patent and that said Letters Patent is hereby corrected as shown below:

Column 2, line 35 change "Reffering" to -Referring-

Column 3, line 3 change "recess 64" to-recess 63-

Column 3, line 7 change "...with as..." to-...with an...-

Column 3, line 23 change "...surface 2..." to -...surface 26.-.

Signed and Sealed this

*First* Day of *October 1985*

[SEAL]

*Attest:*

*Attesting Officer*

DONALD J. QUIGG

*Commissioner of Patents and Trademarks—Designate*